US010393470B1

(12) United States Patent
Popov et al.

(10) Patent No.: US 10,393,470 B1
(45) Date of Patent: Aug. 27, 2019

(54) SUPER COMPACT ARCHERY BOW TECHNOLOGY

(71) Applicant: Sergey Popov, Moscow (RU)

(72) Inventors: Sergey Popov, Moscow (RU); Pavel Ivanov, Moscow (RU)

(73) Assignee: Sergey Popov, Moscow (RU)

( * ) Notice: Subject to any disclaimer, the term of this patent is extended or adjusted under 35 U.S.C. 154(b) by 0 days.

(21) Appl. No.: 15/965,482

(22) Filed: Apr. 27, 2018

(51) Int. Cl.
*F41B 5/12* (2006.01)
*F41B 5/10* (2006.01)

(52) U.S. Cl.
CPC ..... *F41B 5/123* (2013.01); *F41B 5/105* (2013.01)

(58) Field of Classification Search
CPC .... F41B 5/10; F41B 5/105; F41B 5/12; F41B 5/123
See application file for complete search history.

(56) References Cited

U.S. PATENT DOCUMENTS 3,987,777 A * 10/1976 Darlington ..... F41B 5/10 124/25.6
4,077,385 A * 3/1978 Fredrickson ..... F41B 5/10 124/25.6
4,461,267 A * 7/1984 Simonds ..... F41B 5/10 124/25.6
6,776,148 B1 * 8/2004 Islas ..... F41B 5/10 124/25.6
7,578,289 B2 * 8/2009 Norkus ..... F41B 5/0094 124/25
7,823,572 B2 * 11/2010 Anderson ..... F41B 5/123 124/25
7,891,348 B2 * 2/2011 Colley ..... F41B 5/123 124/25
8,651,095 B2 2/2014 Islas
9,297,604 B1 3/2016 Sidebottom
9,354,015 B2 5/2016 Yehle

* cited by examiner

*Primary Examiner* — John A Ricci
(74) *Attorney, Agent, or Firm* — Craft Chu PLLC; Andrew W. Chu

(57) ABSTRACT

The crossbow includes a frame, a first limb and a second limb connected to the frame, a first cam and a second cam mounted on opposite sides of an axis of arrow travel, a string connecting the first cam and the second cam, a first cable connecting the first cam and the first limb, and a second cable connecting the second cam and the second limb. The first cam and the second cam are mounted on a holder of the first cam and a holder of the second cam. The first cam is arranged entirely between the axis of arrow travel and a loose end of the first limb. The second cam is arranged entirely between the axis of arrow travel and a loose end of the second limb. The crossbow reduces overall dimensions of an arrow throwing device while maintaining arrow speed by changing a traditional position of cams.

12 Claims, 10 Drawing Sheets

SUPER COMPACT ARCHERY BOW TECHNOLOGY

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to devices for throwing arrows, in particular, to bows and crossbows.

2. Description of Related Art Including Information Disclosed Under 37 CFR 1.97 and 37 CFR 1.98

Arrow throwing devices are known, such as bows and crossbows. For instance, U.S. Pat. No. 8,651,095 discloses the crossbow comprising the frame, the first limb and the second limb mounted on the frame so that one end of each limb is secured to the frame, and another end of each limb is the loose end. The first cam and the second cam are mounted at the loose ends of the first limb and the second limb, respectively. The first cam and the second cam are connected with the string. In addition, the first cable and the second cable are attached to the first cam and the second cam, respectively, and the other ends of the cables are connected to the projections provided on the frame. Due to the use of cams and cables, the firing speed can be increased. However, such arrangement of the first cam and the second cam at the respective loose ends of the limbs causes the increase in crossbow dimensions, because portions of the cams project beyond the bow dimensions defined by the limbs. This makes usage and transportation of the known crossbow difficult.

U.S. Pat. No. 7,047,958 discloses the bow having a complex system of cams and spools forming the integral complex system. In this device, like in the above crossbow, the elements of the complex system are arranged at the loose ends of the limbs, thus increasing bow dimensions and making usage and transportation thereof quite difficult.

It is also known the bow disclosed in U.S. Pat. No. 4,287,867, wherein the cams are used which actually work as pulleys, or spools, connecting middle portions of the limbs with one of the loose ends of the limbs. The configuration of this known device needs be more sophisticated, as shown in this patent, and requires somewhat longer limbs to provide a high arrow speed. Consequently, it looks impossible to reduce overall dimensions by exclusion of the elements affecting tension of the string because the limbs must be longer to keep arrow speed high.

Therefore, there is the need to reduce overall dimensions of the arrow throwing device while maintaining essential technical characteristics thereof, such as the firing speed of an arrow.

BRIEF SUMMARY OF THE INVENTION

The present invention addresses the mentioned above problem of reduction of overall dimensions of an arrow throwing device while maintaining a high arrow speed by changing a traditional position of cams. In particular, instead of arranging the cams at loose ends of limbs it is suggested to mount the cams within an area defined by an axis of arrow travel and a corresponding loose end of the limb. In a crossbow, the axis of arrow travel extends approximately along a crossbow frame, and in a bow, it extends approximately transversely to a middle portion of a bow handle.

The cams can be arranged both directly on the crossbow frame or the bow handle and on appropriate holders, wherein the holders can be made fixed (i.e., rigid), as well as movable (or flexible).

A string at least partially wraps each of the cams.

Both the crossbow and the bow are fitted with cables connecting each cam with at least one of the loose ends of the corresponding limb.

Advantages of the crossbow and the bow according to the present invention will be described below in details with references to drawings illustrating exemplary embodiments of the present invention which is, however, not limited by the described embodiments.

DETAILED DESCRIPTION OF THE INVENTION

Figure 1:
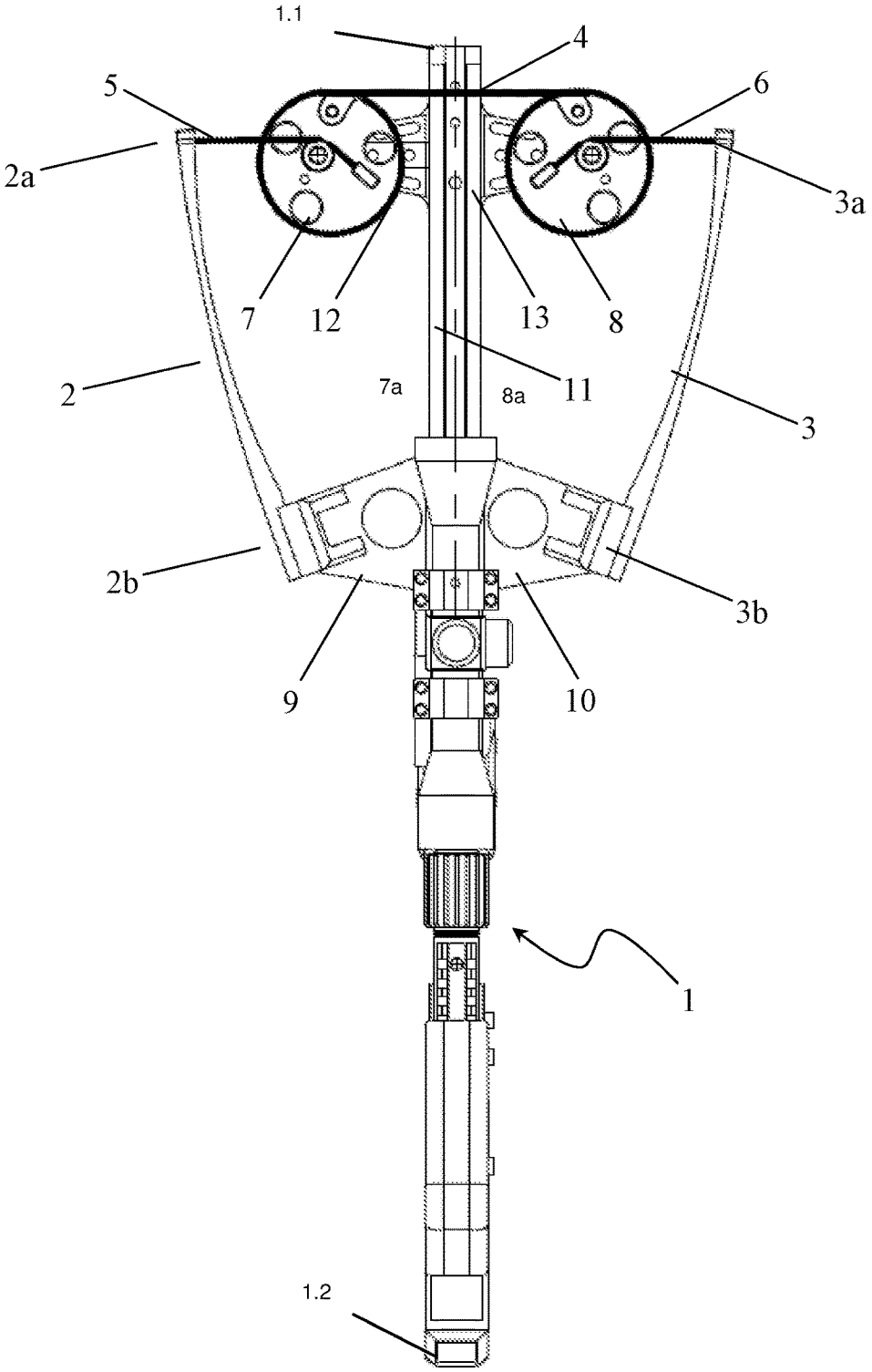
FIGS. 1-7 show top plan views of embodiments of a crossbow in accordance with the present invention.

FIGS. 1-7 show various embodiments of a crossbow in accordance with the present invention.

In general, the crossbow comprises a frame 1 with a front side 1.1 and a back side 1.2, a first limb 2 and a second limb 3, a string 4, at least one first cable 5 and at least one second cable 6, and a first cam 7 and a second cam 8.

Figure 6:
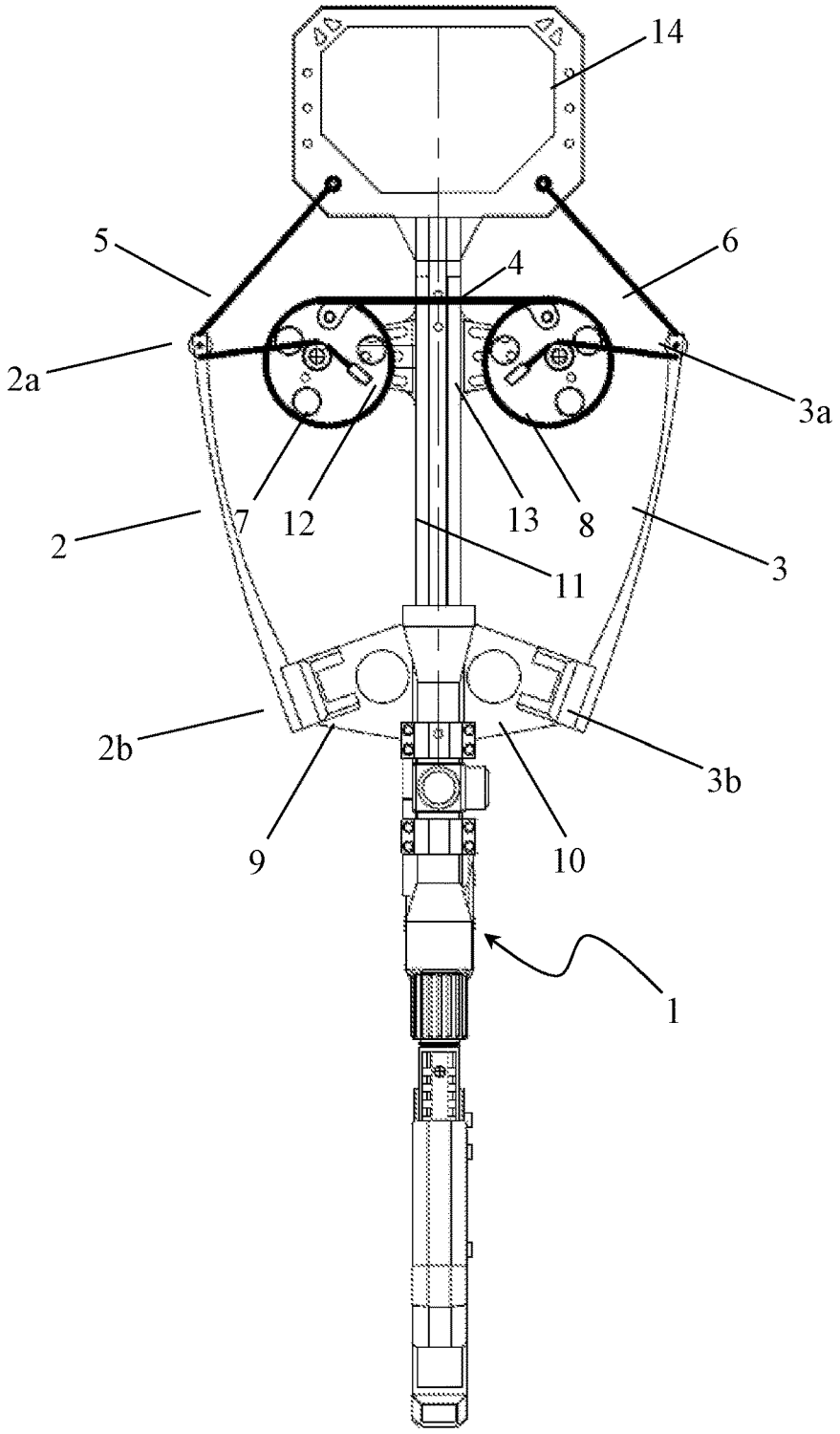
Figure 7:
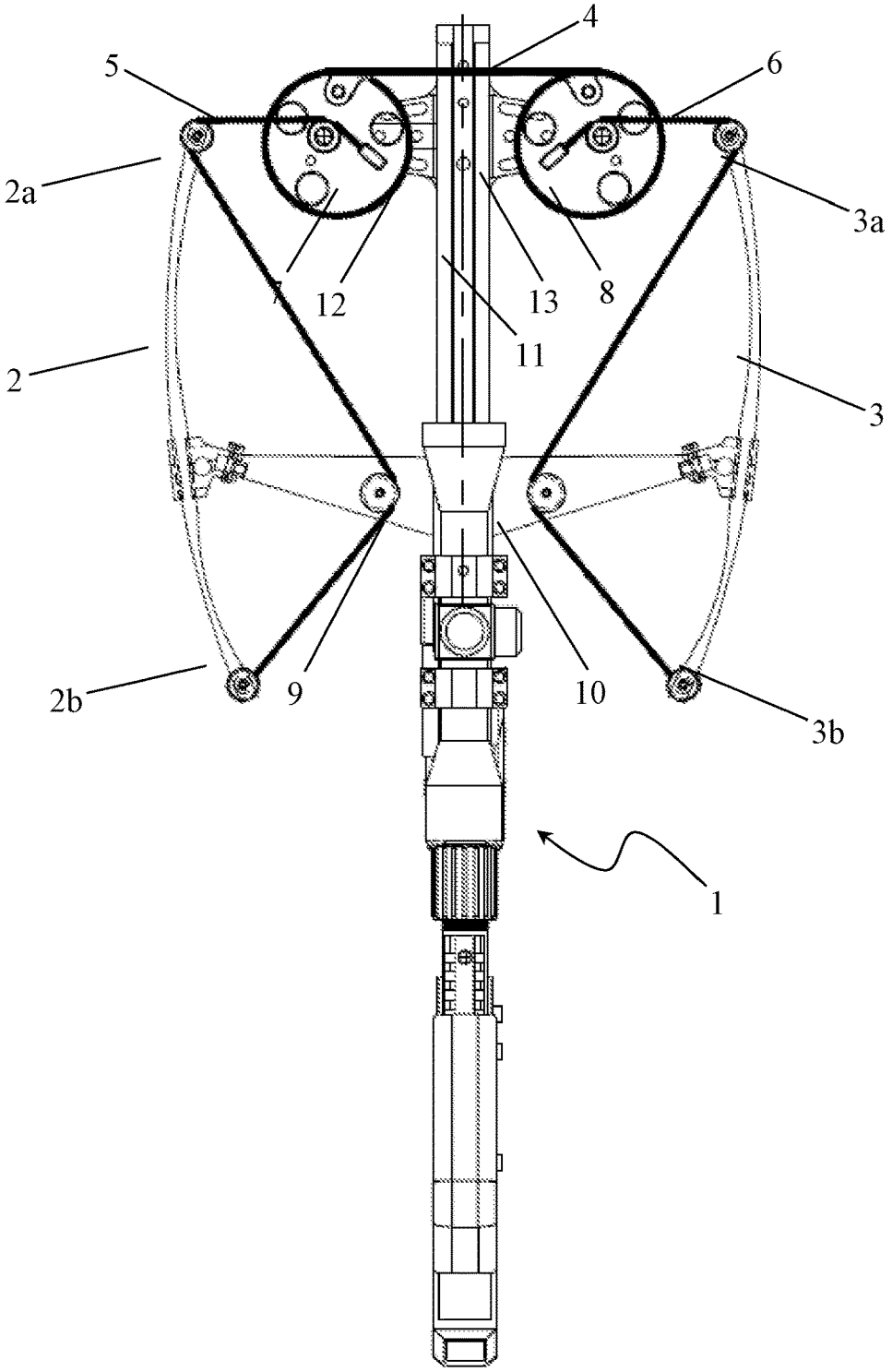

The first limb 2 has two ends 2*a*, 2*b*. The first end or first loose end 2*a* of the first limb is a loose end, and the second end 2*b* of the first limb can be either a secured end (FIGS. 1-6) or a loose end (FIG. 7). Similarly, the second limb 3 has two ends 3*a*, 3*b*. The first end or second loose end 3*a* of the second limb is a loose end, and the second end 3*b* of the second limb can be either a fixed end (FIGS. 1-6) or a loose end (FIG. 7). The fixed ends 2*b*, 3*b* can be attached directly to the frame 1, as shown in FIGS. 2, 3, or it can be attached to the frame 1 via corresponding holders 9, 10 (FIGS. 1, 4-6). If the ends 2*b*, 3*b* are the loose ends, the limbs 2, 3 can be attached at middle portions thereof to the frame via the limb holders 9, 10, respectively (FIG. 7).

The first limb 2 and the second limb 3 can comprise either one portion (FIGS. 1, 4-7), or more than one portion, e.g. two portions 2.1, 2.2 and 3.1, 3.2, respectively, as shown in FIGS. 2, 3.

The loose ends of the limbs 2, 3 can be oriented both in an arrow travel direction (FIGS. 1, 3-6), and in a backward direction of arrow travel (FIG. 2).

The limb holders 9, 10 can be made as separate members which are attached from both sides of the frame 1, or can be a part of the frame 1, or can be one integral member (also known as "a riser") which is attached to the frame 1.

Extended substantially along the frame 1 is an axis 11 of arrow travel along which the arrow (not shown in Figures) is placed when loading into the crossbow and travels on firing.

The first cam 7 and the second cam 8 are mounted on opposite sides, a first side 7*a* for the first cam 7 and a second side 8*a* for the second cam 8, of the frame 1 and the axis 11 of arrow travel, respectively. The first cam 7 and the second cam 8 are attached to the frame 1 via a cam holder 12 of the first cam and a cam holder 13 of the second cam. The cam holders 12, 13, a first cam holder 12 and a second cam holder 13, can be both individual separate members or one integral member, and a part of the frame 1, i.e., they can be made integral to the frame 1.

If the cam holders 12, 13 are individual members, they can be made rigid (maintaining the shape and/or dimensions in normal use of the crossbow), i.e. fixed.

Alternatively, the cam holders 12, 13 can be made movable. For instance, the cam holders 12, 13 can be made of a resilient material. Another possible variant includes a movable attachment of the cam holders 12, 13 to the frame 1.

The first cam 7 is arranged so that when at least the first end 2*a* is at least in a free state (i.e., when the crossbow is not in a drawn state), the first cam 7 is located entirely between the axis 11 of arrow travel and the first end 2*a*. However, when the crossbow is in the drawn state, it may be preferable to have the cam 7 partially projected beyond the overall dimensions of the limb 2. It is further preferable, in case of the crossbow with the limb 2 having two loose ends as shown in FIG. 7, to have the cam 7 entirely between the axis 11 of arrow travel and the ends 2*a*, 2*b*, at least when the crossbow is not in the drawn state.

Similarly, the second cam 8 is arranged so that when at least the first end 3*a* is at least in a free state (i.e. when the crossbow is not in the drawn state), the second cam 8 is located entirely between the axis 11 of arrow travel and the first end 3*a*. However, when the crossbow is in the drawn state, it may be preferable to have the cam 8 partially projected beyond the overall dimensions of the limb 3. It is further preferable, in case of the crossbow with the limb 3 having two loose ends as shown in FIG. 7, to have the cam 8 entirely between the axis 11 of arrow travel and the ends 3*a*, 3*b*, at least when the crossbow is not in the drawn state.

The cams 7, 8 can be any cams well-known to one of ordinary skill in the art.

The string 4 connects the cams 7, 8 and supplies an initial arrow speed. The cables 5, 6 connect the cams 7, 8 to the first ends 2*a*, 3*a*, respectively, as shown in FIGS. 1-6, or to the first and second ends 2*a*, 2*b* and 3*a*, 3*b*, respectively, as shown in FIG. 7.

Figure 2:
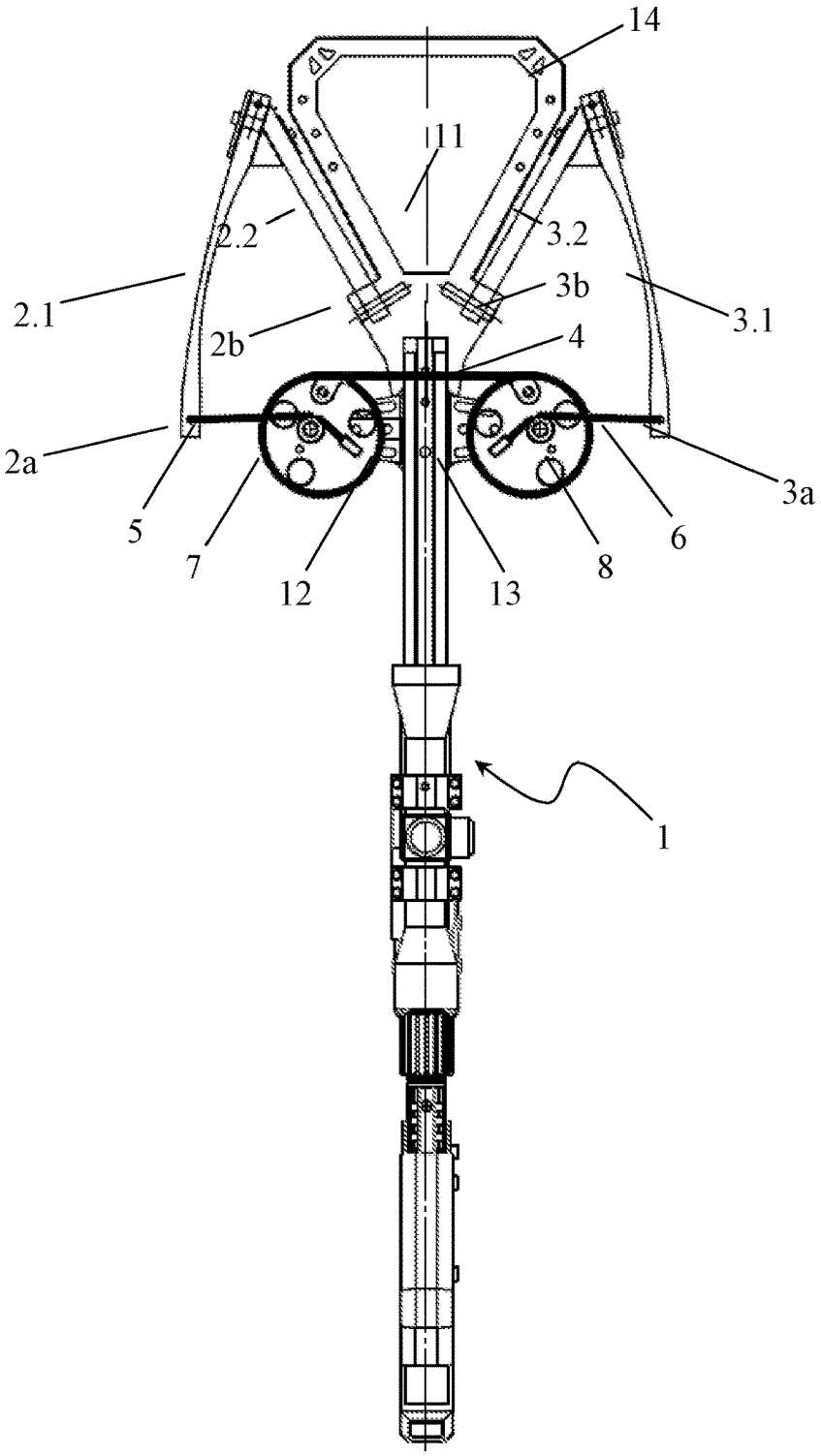
Figure 3:
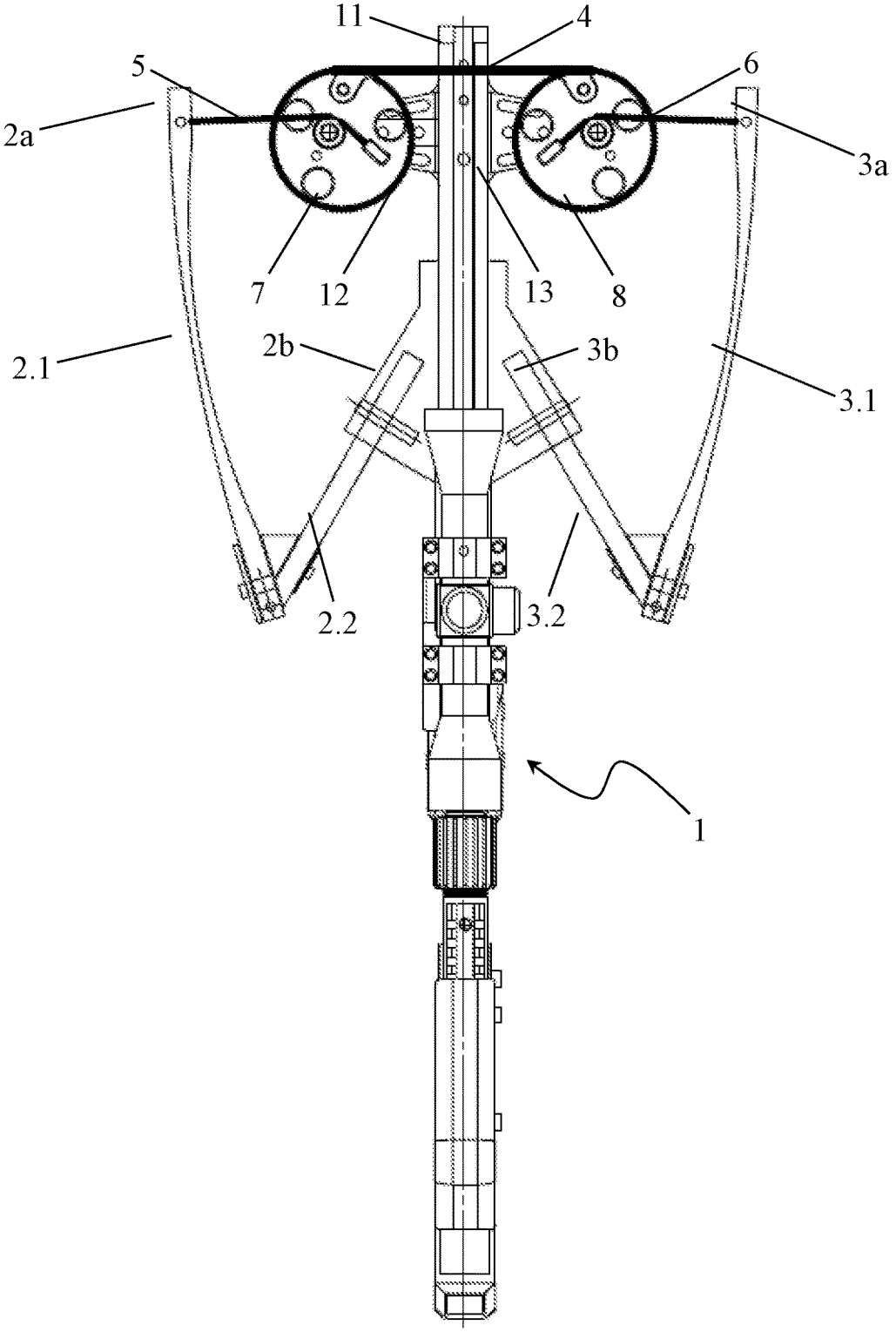
Figure 4:
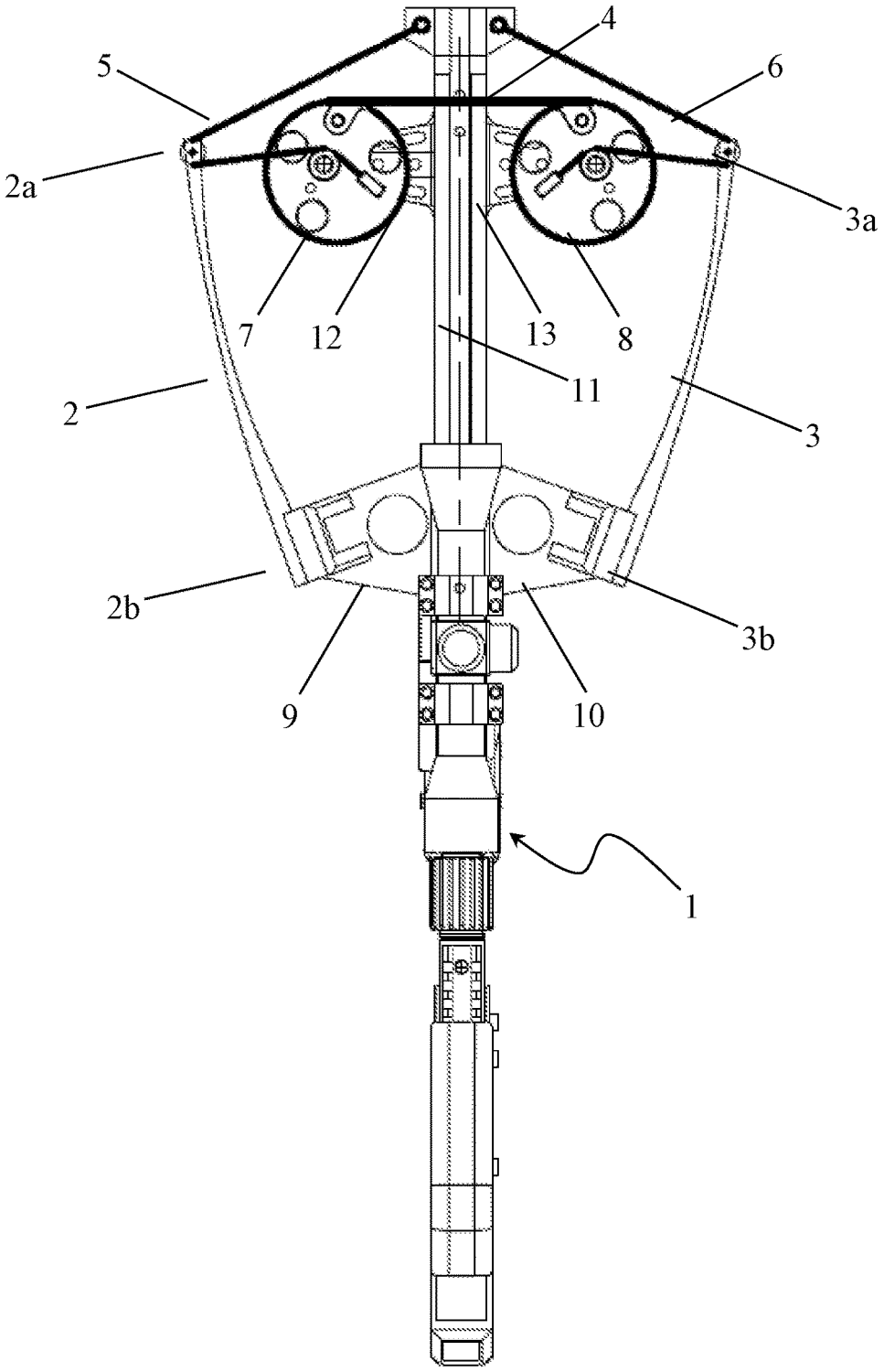
Figure 5:
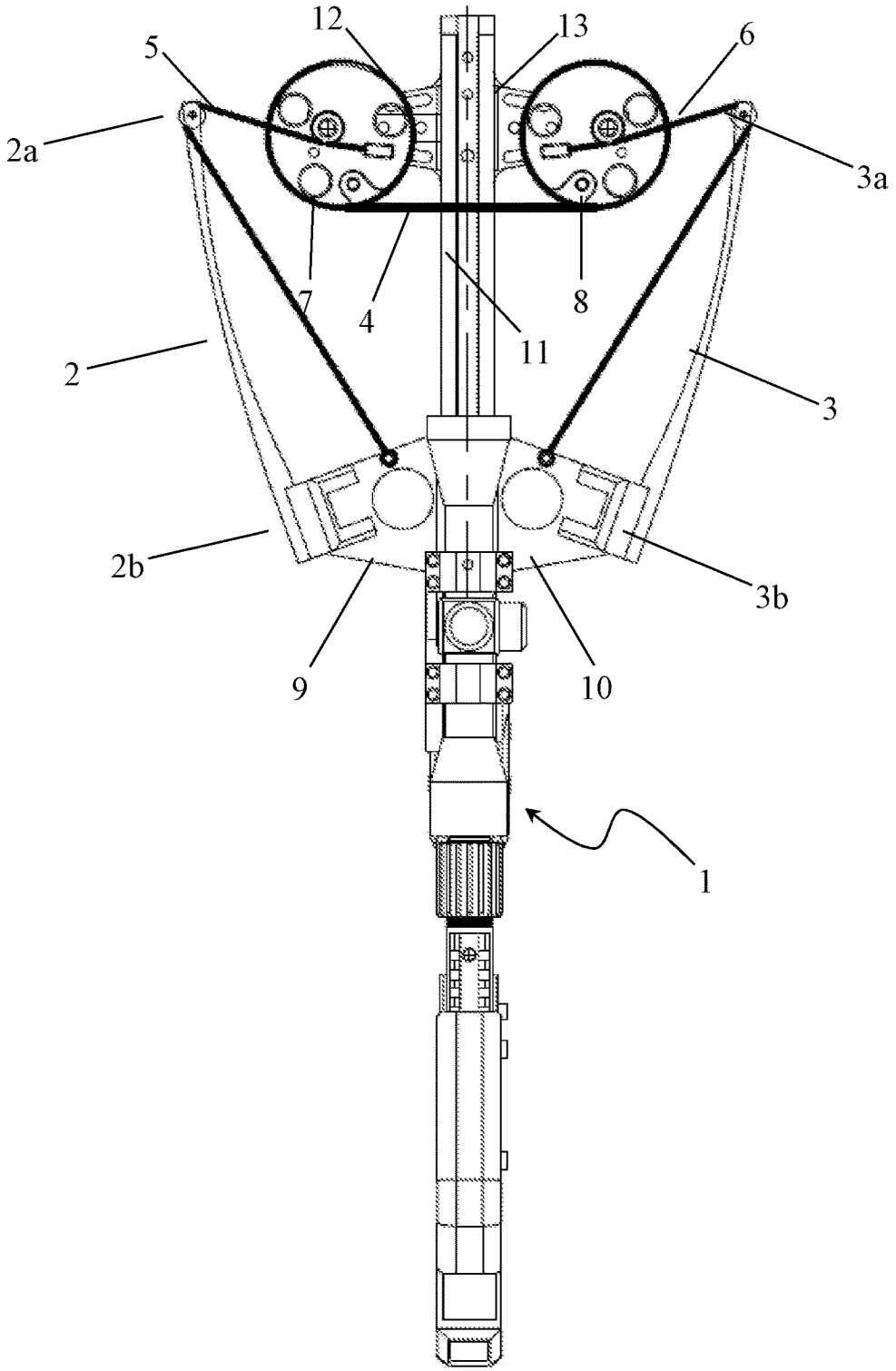

The cables 5, 6 can be attached to the first ends 2*a*, 3*a* (e.g. as shown in FIGS. 1-3). The cables 5, 6 can extend through the first ends 2*a*, 3*a* and be attached to the frame 1 (FIG. 4), or to the limb holders 9, 10 (FIG. 5), or to a foot stirrup 14 (FIG. 6). The cables 5, 6 also can extend through the first ends 2*a*, 3*a* and be attached to the second ends 2*b*, 3*b* (FIG. 7).

FIGS. 1-7 do not represent all possible embodiments of the crossbow in accordance with the present invention. One of ordinary skill in the art would appreciate all other possible embodiments of the crossbow.

When pulling the string 4 back, the cams 7, 8 start rotating about their axes of rotation (not shown in Figures). The cables 7, 8 are wrapped around the cams 7, 8, thus making the first limb 2 and the second limb 3, respectively, bended. The more rigid the limbs 2, 3 are and the more the limbs 2, 3 bend, the higher the initial arrow speed is.

It is preferable to have the first cable 5 entirely arranged on the same side from the axis 11 of arrow travel as the corresponding first cam 7. Similarly, it is preferable to have the second cable 6 entirely arranged on the same side from the axis 11 of arrow travel as the corresponding second cam 8. In this case, the cables 5, 6 will not intersect the axis 11 of arrow travel, i.e., not interfere with the path of arrow loading and not intersect the arrow travel.

Figure 8:
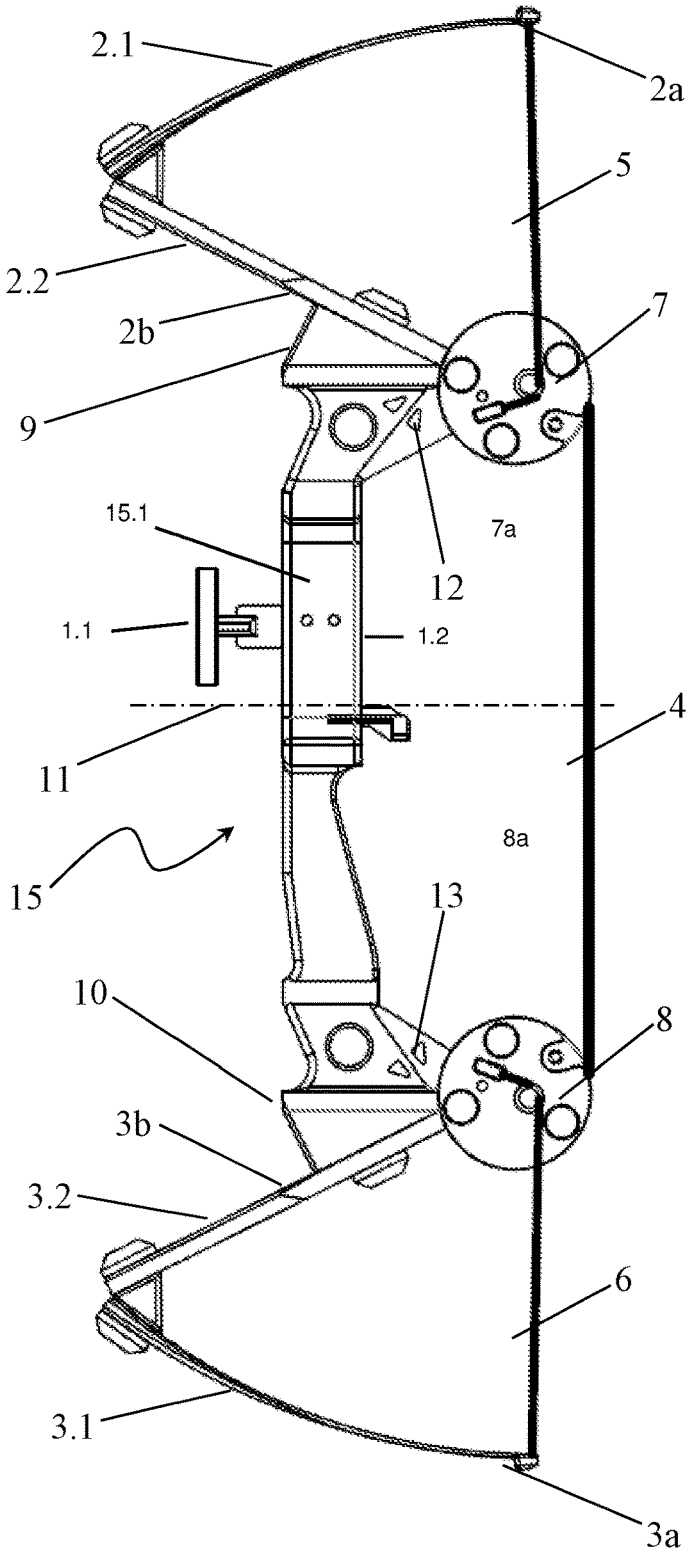
FIGS. 8-10 show side elevation views of embodiments of a bow in accordance with the present invention.
Figure 9:
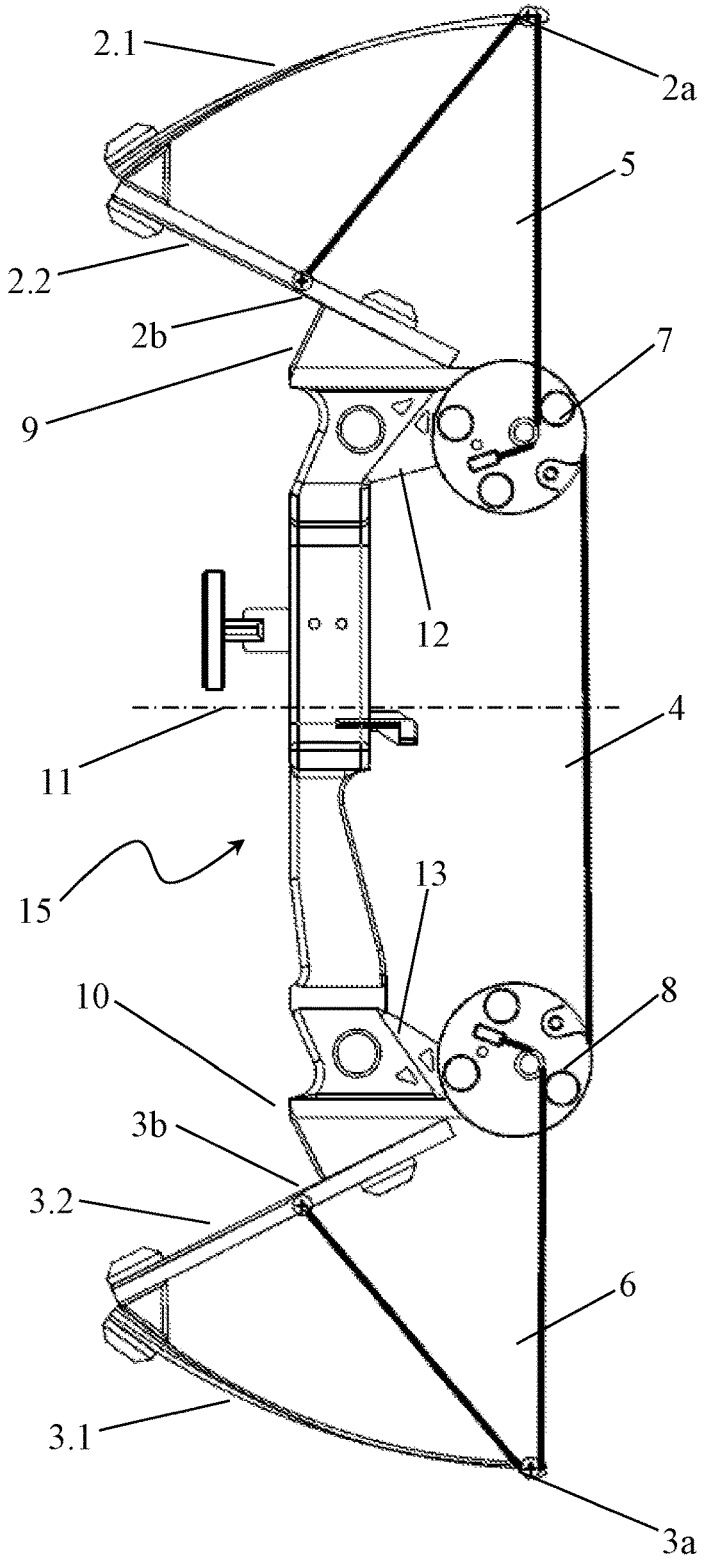
Figure 10:
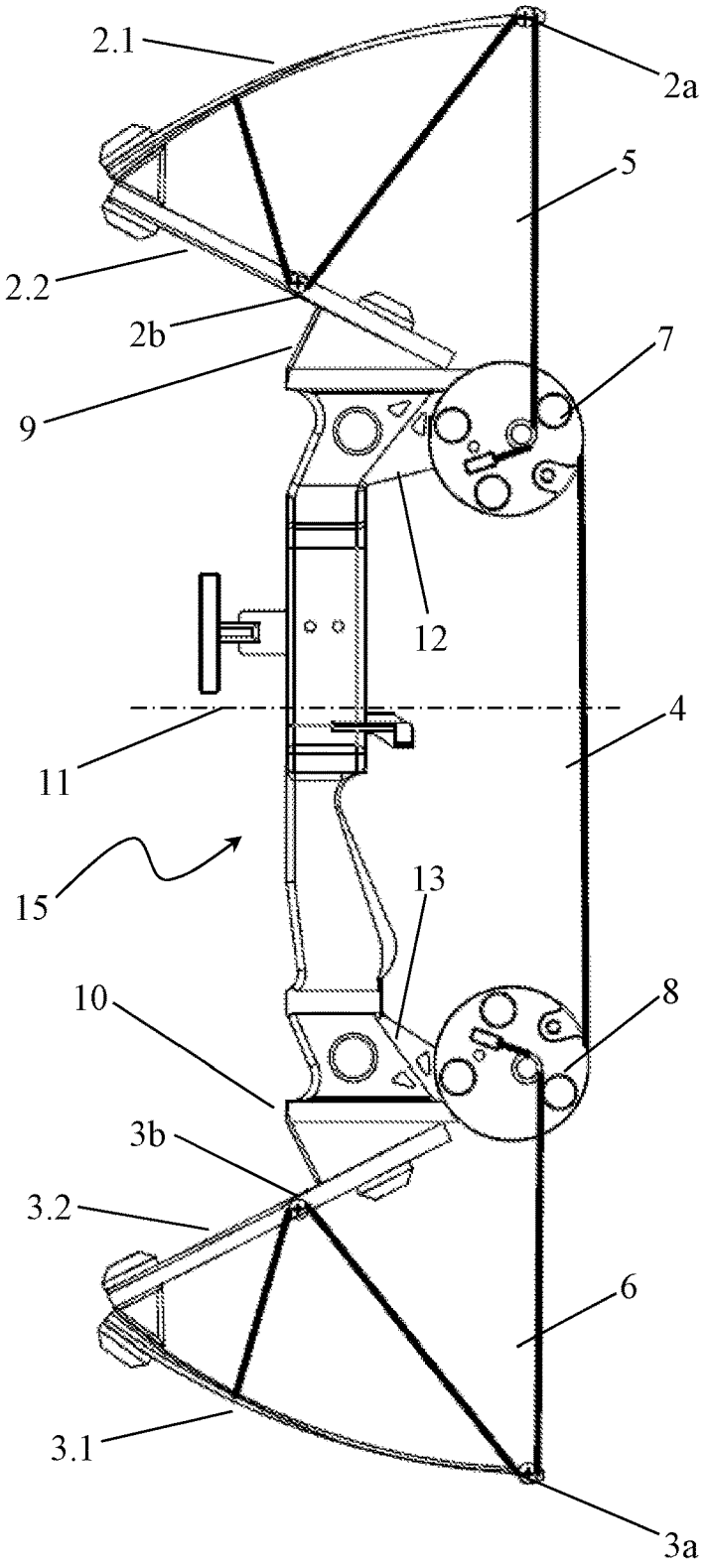

FIGS. 8-10 show embodiments of a bow in accordance with the present invention.

In general, the bow comprises a handle 15 having a midpoint 15.1 with a front side 1.1 and a back side 1.2, a first limb and second limb, a string 4, at least one first cable 5 and at least one second cable 6, and a first cam 7 and a second cam 8.

In the possible embodiments of the bow in accordance with the present invention shown in FIGS. 8-10, the first limb consists of two portions 2.1 and 2.2, and the second limb consists of two portions 3.1 and 3.2. One skilled in the art would appreciate however that the first limb and the second limb each can be a one element if the portions 2.1 and 2.2 are made as a one-piece and the portions 3.1 and 3.2 are made as a one-piece, too.

The first limb has two ends 2*a*, 2*b*. The first end or first loose end 2*a* of the first limb is the loose end, and the second end 2*b* of the first limb is the fixed end. Similarly, the second limb has ends 3*a*, 3*b*. The first end or second loosed end 3*a* of the second limb is the loose end, and the second end 3*b* of the second limb is fixed. The fixed ends 2*b*, 3*b* can be attached directly to the handle 15 or, as shown in FIGS. 8-10, can be attached to the handle 15 via the corresponding holders 9, 10.

Extended substantially transversely to the handle 15 approximately in the middle portion thereof is an axis 11 of arrow travel along which an arrow (not shown in Figures) is arranged when loading into the bow and travels on firing.

The first cam 7 and the second cam 8 are mounted on opposite sides of the handle 15 and the axis 11 of arrow travel, respectively. The first cam 7 and the second cam 8 are attached to the handle 15 via a cam holder 12 of the first cam and a cam holder 13 of the second cam. The cam holders 12, 13 can be individual separate members or one integral member, and can be a part of the handle 15, i.e., they can be made integral to the handle 15.

If the cam holders 12, 13 are individual members, they can be made rigid (maintaining the shape and/or dimensions thereof in normal use of the bow), i.e. fixed.

Alternatively, the cam holders 12, 13 can be made movable. For instance, the cam holders 12, 13 can be made of a resilient material. Another possible variant includes a movable attachment of the cam holders 12, 13 to the handle 15.

The first cam 7 is arranged so that when at least the first end 2*a* is at least in a free state (i.e. when the bow is not in a drawn state), the first cam 7 is located entirely between the axis 11 of arrow travel and the first end 2*a*. Similarly, the second cam 8 is arranged so that when at least the first end 3*a* is at least in the free state (i.e. when the bow is not in the drawn state), the second cam 8 is located entirely between the axis 11 of arrow travel and the first end 3*a*.

The cams 7, 8 can be any cams well-known to one of ordinary skill in the art.

The string 4 connects the cams 7, 8 and supplies an initial arrow speed. The cables 5, 6 connect the cams 7, 8, respectively, to the first ends 2*a*, 3*a*.

The cables 5, 6 can be attached to the first ends 2*a*, 3*a*, as shown in FIG. 8. The cables 5, 6 can extend through the first ends 2*a*, 3*a* and be attached to the second portions of the limbs 2*b*, 3*b*, as shown in FIG. 9. The cables 5, 6 can extend through the first ends 2*a*, 3*a*, further through the second portions of the second portions of the limbs 2*b*, 3*b* and be attached to the first portions of the limbs 2*a*, 3*a*, as shown in FIG. 10. The one skilled in the art would appreciate other possible embodiments of the attachment of the ends of the cables 5, 6 that are not shown in Figures, such as on the limb holders 9, 10.

FIGS. 8-10 do not represent all possible embodiments of the bow in accordance with the present invention. One of ordinary skill in the art would appreciate all other possible embodiments of the bow.

When pulling the string 4 back, the cams 7, 8 start rotating about their axes of rotation (not shown in Figures). The cables 7, 8 are wrapped around the cams 7, 8, thus bending the first limb and the second limb, respectively. The more rigid the first limb and the second limb are and the more these limbs bend, the higher the initial arrow speed is.

It is preferable to have the first cable 5 entirely arranged on the same side from the axis 11 of arrow travel as the corresponding first cam 7. Similarly, it is preferable to have the second cable 6 entirely arranged on the same side from the axis 11 of arrow travel as the corresponding second cam 8. In this case, the cables 5, 6 will not intersect the axis 11 of arrow travel, i.e., not interfere with the path of arrow loading and not intersect the arrow travel.

In addition to the indicated above decrease of the overall dimensions while maintaining the firing speed, further advantages of the claimed arrow throwing devices over the known crossbows and bows are worth mentioning.

Firstly, placing the cams closer to the axis of arrow travel and, therefore, to the area which is hand-held by a user during the use of an arrow throwing device allows to reduce the torque developed by said device. This contributes to the more stable holding of the crossbow or bow resulting in lower arm loading, in particular, a user hand loading.

Secondly, since the cams are now displaced from the loose ends of the limbs, the load applied to these loose ends of the limbs is reduced. To attach the cam to the loose end of the limb, as used in the known devices, a tip of the loose end of the limb has to be provided with openings and/or cutouts, and therefore the loose end of the limb has to be reinforced. In addition, during the use of the known devices the cams can slightly shift with respect to attachment axes thereof, thus leading to additional rotational loads applied to the loose ends of the limb. If the cams are not located at the loose ends of the limbs like in the present invention, there is no need to reinforce the loose ends.

Thus, the present invention provides significant advantages over the known crossbows and bows and yet has no impact on one of the main characteristics, namely, the initial speed of arrow flight.

We claim:

1. A crossbow, comprising:

a frame with an axis of arrow travel extending along said frame;

a first limb being connected to said frame and being comprised of at least one first loose end;

a second limb being connected to said frame and being comprised of at least one second loose end;

a first cam mounted on a first side of said frame;

a second cam mounted on a second side of said frame, said first side being opposite said second side along said axis of arrow travel;

a first holder between said first cam and said frame, said first cam being mounted on said first holder;

a second holder between said second cam and said frame, said second cam being mounted on said second holder;

a string connected to said first cam and said second cam, said string having a free state and a drawn state;

at least one first cable connected to said first cam and said at least one first loose end; and at least one second cable connected to said second cam and said at least one second loose end, wherein the first cam is arranged entirely between the axis of arrow travel and said at least one first loose end, when said string is in said free state, wherein the second cam is arranged entirely between the axis of arrow travel and said at least one second loose end, when said string is in said free state, wherein said at least one first cable is arranged entirely on said first side, and wherein said at least one second cable is arranged entirely on said second side.

2. The crossbow of claim 1, wherein said first limb is comprised of a plurality of first limb portions, and wherein said second limb is comprised of a plurality of second limb portions.

3. The crossbow of claim 1, wherein said first holder is fixed when said string is in said drawn state, and wherein said second holder is fixed when said string is in said drawn state.

4. The crossbow of claim 1, wherein said first holder is movable when said string is in said drawn state, and wherein said second holder is movable when said string is in said drawn state.

5. The crossbow of claim 1, wherein said first holder is made integral with said frame, and wherein said second holder is made integral with said frame.

6. The crossbow of claim 1, wherein said first holder is removably attached to said frame, and wherein said second holder is removably attached to said frame.

7. A bow, comprising:

a handle having a midpoint and an axis of arrow travel extending through said midpoint and transverse to said handle;

a first limb being connected to said handle and being comprised of at least one first loose end;

a second limb being connected to said handle and being comprised of at least one second loose end;

a first cam mounted on a first side of said handle;

a second cam mounted on a second side of said handle, said first side being opposite said second side at said midpoint of said handle along said axis of arrow travel;

a first holder with said first cam mounted on said first holder;

a second holder with said second cam being mounted on said second holder;

a string connected to said first cam and said second cam, said string having a free state and a drawn state;

at least one first cable connected to said first cam and said at least one first loose end; and at least one second cable connected to said second cam and said at least one second loose end, wherein the first cam is arranged entirely between the axis of arrow travel and said at least one first loose end, when said string is in said free state, wherein the second cam is arranged entirely between the axis of arrow travel and said at least one second loose end, when said string is in said free state, wherein said at least one first cable is arranged entirely on said first side, and wherein said at least one second cable is arranged entirely on said second side.

8. The bow of claim 7, wherein said first limb is comprised of a plurality of first limb portions, and wherein said second limb is comprised of a plurality of second limb portions.

9. The bow of claim 7, wherein said first holder is fixed when said string is in said drawn state, and wherein said second holder is fixed when said string is in said drawn state.

10. The bow of claim 7, wherein said first holder is movable when said string is in said drawn state, and wherein said second holder is movable when said string is in said drawn state.

11. The bow of claim 7, wherein said first holder is made integral with said handle, and wherein said second holder is made integral with said handle.

12. The bow of claim 7, wherein said first holder is removably attached to said handle, and wherein said second holder is removably attached to said handle.

* * * * *